United States Patent [19]

Taylor

[11] 4,418,336

[45] Nov. 29, 1983

[54] ALARM INDICATING DISLOCATION OF FIRE EXTINGUISHER

[76] Inventor: John D. Taylor, 3951 Lotus Dr., Waterford, Mich. 48095

[21] Appl. No.: 284,474

[22] Filed: Jul. 17, 1981

[51] Int. Cl.[3] ..... G08B 13/14

[52] U.S. Cl. ..... 340/571; 169/51; 200/61.58 R

[58] Field of Search ..... 340/571, 568, 547; 169/23, 51; 200/61.58 R

[56] References Cited

U.S. PATENT DOCUMENTS

| | | | |
|---|---|---|---|
| 2,780,689 | 2/1957 | La Cavera | 200/61.93 |
| 3,597,557 | 8/1971 | Floessel | 200/148 R |
| 3,696,380 | 10/1972 | Murphy | 340/547 |
| 3,755,778 | 8/1973 | Kennedy et al. | 340/571 |
| 3,887,909 | 6/1975 | Beiswenger et al. | 340/274 |
| 4,003,048 | 1/1977 | Weise | 340/568 |
| 4,015,250 | 3/1977 | Fudge | 340/568 |
| 4,063,241 | 12/1977 | Harsnett | 346/33 R |
| 4,234,879 | 11/1980 | Baker | 340/568 |
| 4,236,148 | 11/1980 | Guruis | 340/568 |

*Primary Examiner*—Glen R. Swann, III

*Attorney, Agent, or Firm*—Gifford, Van Ophem, Sheridan & Sprinkle

[57] ABSTRACT

An alarm device for a fire extinguisher to detect when the fire extinguisher is removed from its storage post includes a flexible cable which is slidably insertable within a guide passage between the permanent magnet and a reed switch. One end of the cable is inserted into an alarm housing which contains the reed switch and magnet while the other end of the cable is fixedly secured to a fire extinguisher of the stationary support post. In the first instance, the alarm housing is secured to the stationary storage post while in the second case the alarm unit 16 is secured by a harness to the fire extinguisher itself. In either case, movement of the fire extinguisher causes the flexible cable to withdraw from the alarm housing and closed the reed switch to complete a circuit which produces an audible alarm signal.

10 Claims, 5 Drawing Figures

ALARM INDICATING DISLOCATION OF FIRE EXTINGUISHER

BACKGROUND OF THE INVENTION

Field of the Present Invention

The present invention relates generally to an alarm unit for providing an audible signal when a fire extinguisher is removed from its storage post and, more particularly, to such an alarm unit which can be conveniently carried by the fire extinguisher so as to be portable therewith or which can be conveniently secured to the stationary storage post for the fire extinguisher.

Description of the Prior Art

Fire extinguishers are often stored in highly visible and readily accessible storage areas in a plurality of locations throughout large public and private buildings as is often required by fire regulations and ordinances. However, such positioning makes the fire extinguishers vulnerable to tampering by pranksters, vandals and the like. Accordingly, it would be advantageous to be able to detect such tampering by providing an alarm which detects when the fire extinguisher is being dislocated or removed from its storage station or post.

One previously known device for sounding an audible alarm when the storage post is tampered with is shown in U.S. Pat. No. 4,015,250 to Fudge. Fudge discloses a cabinet in which the fire extinguisher can be stored. The cabinet includes a hinged door and a plunger-type switch which is activated when the door is opened and, thus, sounds a local alarm secured within the cabinet. Nevertheless, the fire extinguisher can be removed from the cabinet and silently transported away once the fire extinguisher has been removed from the area in which the local alarm is sounded. Moreover, the alarm can be easily deactivated by pressing in the plunger or closing the cabinet door once the fire extinguisher has been removed. Thus, the alarm may be audible for only a short interval which is insufficient to provide adequate warning of tampering with the fire extinguisher.

Another known alarm for detecting removal of a fire extinguisher from its storage post is disclosed in U.S. Pat. No. 4,003,048 to Weise. Weise discloses the use of an electrically conductive breakaway lanyard which is looped around the neck of a fire extinguisher. The ends of the wire lanyard are locked in a spaced apart parallel disposition by and extend outwardly from a guide block. Thus, the ends of the lanyard are positioned to be slidably insertable into female receptacles in a housing jack secured to a wall mounting bracket. The receptacles include conductive elements which permit the lanyard to complete the supervisory electrical circuit. When the lanyard is broken or the prongs removed from the receptacles, the supervisory circuit is open circuited whereby a relay in a second alarm circuit closes and causes the alarm to provide a warning signal. Such an alarm system is disadvantageous for the reason that electrical power must be continuously applied to the supervisory circuit. Moreover, the lanyard could easily be shortcircuited before the lanyard portion surrounding the neck is broken so that the extinguisher can be removed without causing the alarm to sound. In addition, Weise teaches that the alarm signal is remote from the fire extinguisher itself and even from the stationary storage post.

Another previously known type of alarm comprises the use of a trip wire which is biased at a predetermined tension so that increasing or decreasing the tension of the wire actuates an alarm signal. However, these devices are disadvantageous for the reason that they are quite complicated and thus expensive to produce. Moreover, although such devices are quite sensitive and, therefore, are difficult to override, they require concerted effort to accurately adjust the trip wire to its operative position.

SUMMARY OF THE PRESENT INVENTION

The present invention overcomes the above disadvantages by providing an alarm for detection of the dislocation of a portable fire extinguisher from a relatively stationary storage post comprising an elongated, flexible member extending between the fire extinguisher and the stationary storage post. One free end of the flexible member is inserted in a guide passageway within an alarm unit housing, which housing is secured to either the fire extinguisher or the storage post. The other end of the flexible member is secured to the other of either the extinguisher or support post. Withdrawal of the flexible member from the alarm unit housing by removal of the extinguisher from its support post activates an audible alarm in the housing.

Preferably, the guide passage for the flexible member is curved so that rigid articles cannot be inserted in the housing to reopen the electrical circuit which sounds the alarm. Except for the opening in the alarm unit housing in which the flexible member is inserted and an opening to permit the audible alarm to be heard exteriorly of the alarm unit housing, the housing of the alarm unit is totally enclosed so that none of the circuit components can be tampered with to avoid or interrupt actuation of the alarm. In addition, the alarm unit housing includes a restricted access cover plate to permit replacement of the electrical power source retained within the alarm unit housing. Since the cover plate is removable, it is preferable to include a further switch which actuates the alarm when the cover plate has been removed from the alarm unit housing.

Accordingly, the present invention provides a simple and effective alarm unit for sounding an audible alarm when the fire extinguisher is removed from its stationary storage post. When the alarm unit is secured to the fire extinguisher itself, the alarm unit provides a portable signal which travels wherever the fire extinguisher is transported and, thus, provides a highly traceable indication of the location of the fire extinguisher removed. Alternatively, when the alarm unit is rigidly secured to a stationary storage post, a device provides an audible signal which indicates the position at which a fire extinguisher was removed. In either case, it will be understood that once the fire extinguisher is removed from its stationary storage post, the alarm cannot be readily turned off and continues to emit an audible signal. These and other important advantages of fire extinguisher alarm of the present invention will be recited in more detail in the following detailed description.

BRIEF DESCRIPTION OF THE DRAWING

The present invention will be better understood by reference to the following detailed description of the present invention when read in conjunction with the accompanying drawing in which like reference characters refer to like parts throughout the several views, and in which.

DETAILED DESCRIPTION OF A PREFERRED EMBODIMENT OF THE PRESENT INVENTION

Figure 1:
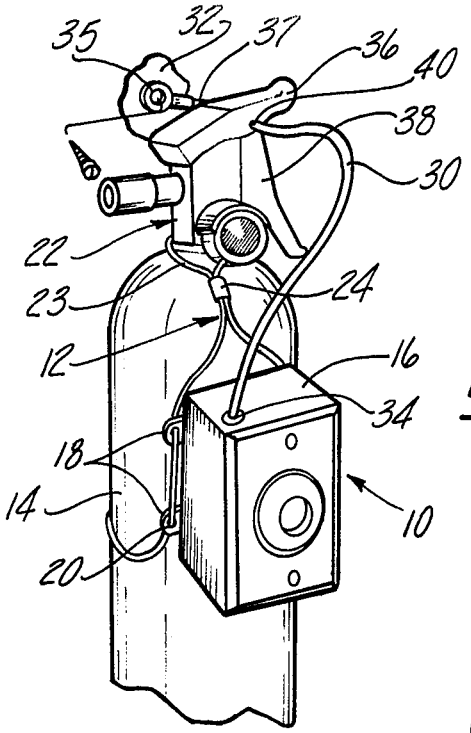
FIG. 1 is a perspective view of the fire extinguisher alarm of the present invention secured by a harness to a fire extinguisher.

Referring first to FIG. 1, an alarm device 10 according to the present invention is thereshown secured by a harness 12 to the body of a fire extinguisher 14. The alarm device 10 includes a housing 16 and a pair of tabs 18, secured to the rear wall of the housing 16, extend laterally outward from each side of the housing 16. A multistrand, wound wire cable 23 is looped around the neck 22 of the fire extinguisher 14. A crimp lock 24 encloses the loop around the neck 22. The remaining portions of the cable 23 are looped through the apertures 17 in the extended tabs 18, then wrapped around the fire extinguisher 14 where the ends are then connected by a crimp clamp (not shown) similar to the crimp clamp 24.

Another cable 30 which can be quite similar to the cable 23, extends between the housing 16 and the building wall 32 to which the fire extinguisher is supportedly attached by appropriate means (not shown). One free of the cable 30 is inserted into an aperture 34 in the housing 16 while the other end includes appropriate means for fixedly securing the cable 30 to the wall 32. As shown in FIG. 1, the other end of the cable 30 includes a looped terminal connector 35 fixedly secured at the end. The connector 35 receives a threaded fastener therethrough to securely fasten the cable 30 to the wall 32. Preferably, the threaded fastener 36 includes an enlarged head with an unconventional tool-engaging configuration so that a special tool rather than a commonly available tool must be used to extract the threaded fastener from the wall 32.

Still referring to FIG. 1, it can be seen that the fire extinguisher 14 includes a pair of handle members 38 and 40 which have registering apertures adapted to receive a locking pin (not shown) so that the extinguisher cannot be accidentally activated. Although various styles of fire extinguishers are available and may not include the pair of handle members 36 and 38, fire extinguishers often include a locking pin which is engaged in registering apertures through at least one handle member to prevent an inadvertent operation of the handle. In either event, and in accordance with the present invention, the cable 30 is conveniently inserted through the registering apertures, as illustrated at 40, in place of the locking pin. Since the terminal connector 35 is securely fastened to the wall 32, the first end of the cable 30 must be removed from the aperture 34 in housing 16 in order to release the handle portions 36 and 38 to make them operable.

Figure 2:
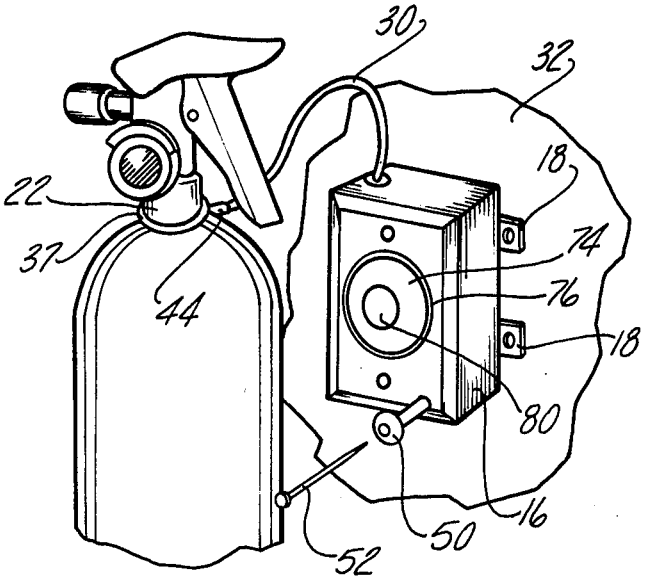
FIG. 2 is a fragmentary perspective view of an alarm device according to the present invention but showing a modification of the installation shown in FIG. 1.

Referring now to FIG. 2, the alarm housing 16 is shown secured to the wall 32 through the laterally extending tabs 18. To securely mount the housing 16 to the wall 32, holes (not shown) can be drilled in the wall and insertable anchors 50 can be inserted into the holes in the tabs 18 and into the holes in the wall. An elongated wedge type fastener such as a nail 52 is then driven into the anchor 50. Such mounting of the housing 16 makes it difficult to remove the housing from the wall 32. However, it will also be understood that other securing means such as screws 36 are also within the scope of the present invention.

The end 37 of the cable 30 is then looped around the neck 22 of the fire extinguisher 14 and the loop is closed by a crimp clamp 44 in the well known manner. As in the embodiment in FIG. 1, the other end of the cable 30 is inserted into the aperture 34 in the alarm housing 16. Thus, when the fire extinguisher 14 is moved away from the wall 32, the cable 30 is withdrawn from the aperture 34 in housing 16 and causes the alarm circuit to sound an alarm in a manner which will be described hereinafter in detail. It will also be understood that in the embodiment in FIG. 2, the cable 30 can be inserted through apertures 40 (FIG. 1) in the handle portions 36 (FIG. 1) and 38 (FIG. 1) or similar structures so that the cable 30 must be removed from the aperture 34 in alarm housing 16 before the fire extinguisher 14 is made operable.

Figure 3:
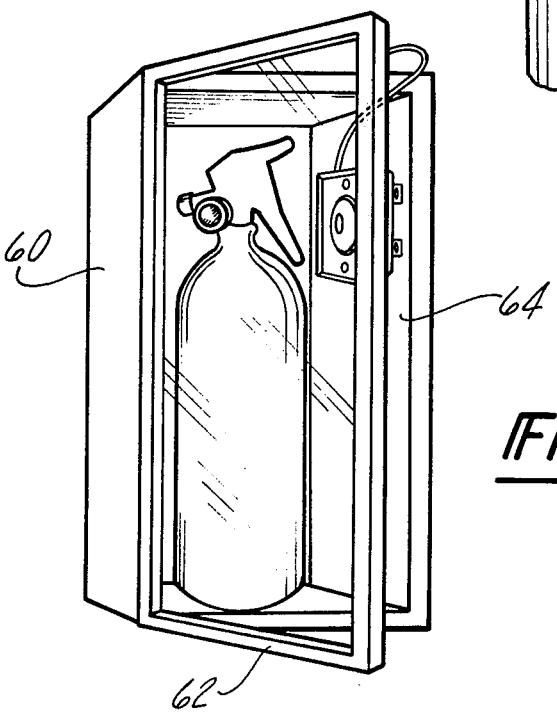
FIG. 3 is a perspective view of an alarm device according to the present invention and showing a further modification thereof.

Referring now to FIG. 3, a further application of the alarm device 10 of the present invention is thereshown comprising a cabinet 60 having a door 62 hingedly secured to the open front of the cabinet. In this case, the alarm housing 16 is secured to a wall 64 of cabinet 60. This can be done by mounting anchors 50 and nails 52, threaded screws or other means. The end 37 of cable 30 is secured to the free end of the door 62 by appropriate fastening means (not shown) such as, for example, a terminal connector 35 and screw 36. Thus, when the door is moved to its open position as shown in FIG. 3, the cable 30 is pulled from the aperture 34 in the alarm housing 16.

Figure 4:
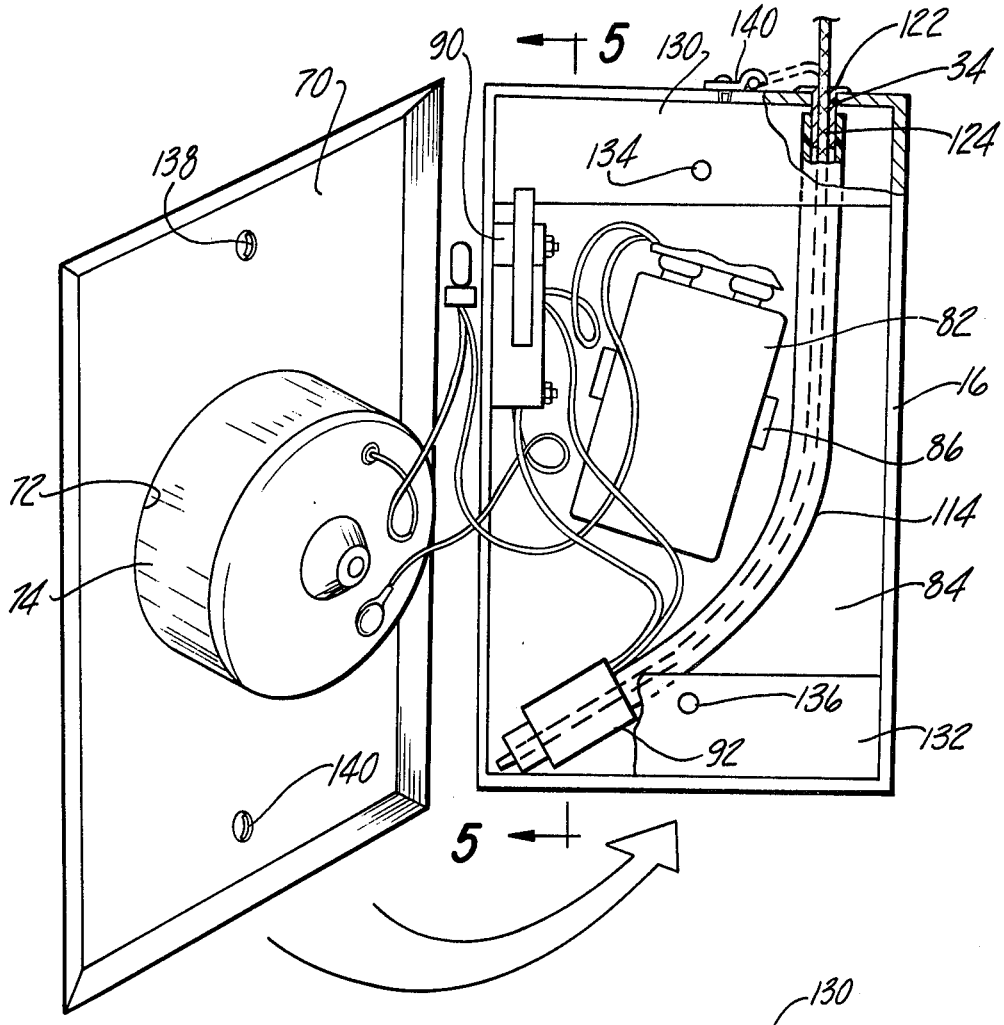
FIG. 4 is a side plan view of an alarm device in accordance with the present invention with a portion repositioned for clarity.

Referring now to FIG. 4, the interior of the housing 16 is shown by removal of the cover plate 70. The cover plate 70 includes an aperture 72 dimensioned to slidably receive the housing of the audio alarm 74. A radially extending lip 76 (see FIG. 2) limits the extent to which the housing of the alarm 74 can be inserted within the aperture 72. Appropriate means such as solder or epoxy secures the alarm 74 to the cover plate 70. It can be seen that the sound radiator 80 (see FIG. 2) faces outwardly from the housing 16, so as to be audible exteriorly of the housing.

A battery power source 82 is contained within a housing 16 and can be secured to the rear wall 84 of the housing 16 by an adhesive retaining member 86. The battery 82 is electrically connected in series with the alarm 74 through a parallel arrangement of two switches 90 and 92 with appropriate wires.

Figure 5:
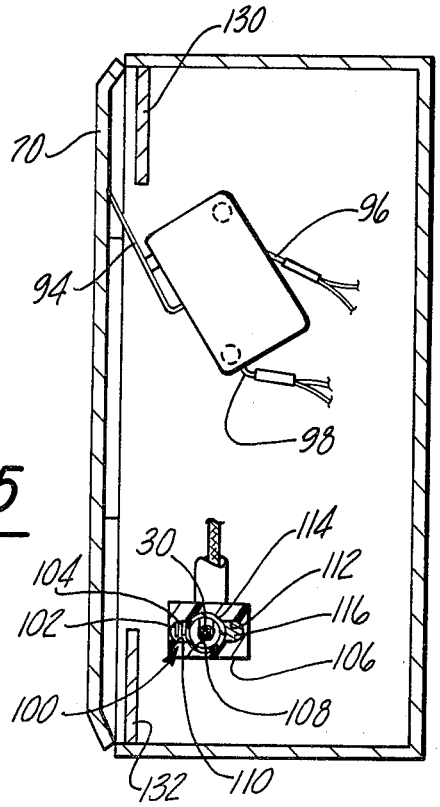
FIG. 5 is a sectional view taken substantially along the line 5—5 in FIG. 4.

Referring now to FIG. 5, the switch 90 is thereshown comprising a microswitch having a lever 94 which is normally biased away from the body of microswitch 90 so that the lever 94 extends outwardly from the interior of the housing 16. However, as shown in FIG. 5, when the cover plate 70 is secured to the housing 16, the lever 94 is pushed inwardly from its normally biased position and thus opens the electrical circuit between wires 96 and 98. Accordingly, the switch 90 is closed and completes the alarm circuit whenever the cover plate 70 is removed from the housing 16, whereby the alarm 74 provides an audible signal that the device is being tampered with.

The switch 92 comprises nonconductive housing block 106 having a first throughbore 108 as well as bores 110 and 112 adjacent opposing sides of the throughbore 108. The throughbore 108 is dimensioned to receive a tube 114 while the bore 110 houses a reed switch 100 and the bore 112 contains a permanent magnet 116.

The tube 114 is substantially longer than the height of the housing 16 so that the tube must curve as shown in FIG. 4. The upper end of the tube 114 is pressed onto the elongated stem portion of a fitting 122. The fitting 122 includes a throughbore 124 dimensioned to slidably receive the flexible cable 30. Accordingly, when the flexible cable 30 is inserted through the fitting 122, it enters tube 114 and follows the curvature of the tube. Since the lower end of the tube 114 extends through the switch housing 106, the cable 30 also extends through throughbore 108 intermediate the reed switch 100 and the permanent magnet 116. In this manner, the conductive flexible cable 30 increases the strength of the magnetic field reaching the reed switch from the permanent magnet 116 so that it separates the contacts 102 and 104 of the reed switch 100 against the force of the reed. Nevertheless, it will be understood that when the cable 30 is removed from between the permanent magnet 116 and the reed switch 100, the magnetic field at the reed switch decreases due to the air gap between the magnet and the reed switch 100. Accordingly, the resiliency of the reed causes the contact 102 to close against the contact 104. Consequently, the circuit between the battery 82 in the alarm 74 is closed and the device emits an audible alarm.

Referring to FIGS. 4 and 5, it can be seen that the housing 16 is provided with connecting bars 130 and 132 which extend inwardly near the open end of the housing 16. Bars 130 and 132 include threaded apertures 134 and 136 respectively which receive threaded fasteners installed through the registering apertures 138 and 140 in the cover plate 70. Preferably, the fastener used has an unconventional head and works the same way and for the same purpose that the screw 36 is provided with an unconventional head shape as previously discussed. However, since the switch 90 provides an audible signal whenever the cover plate 70 is removed from the housing 16, conventional bolts can be used to secure the cover plate 70 to the alarm housing 16.

In order to prevent unnecessary alarm signals when the fire extinguisher is not being removed but is stored at a post where passersby could inadvertently bump the extinguisher and dislodge the cable from its fully inserted position, it is advantageous to provide a resilient retainer to keep the cable 30 in its fully inserted position within the housing. Accordingly, as shown in dotted lines in FIG. 4, a resilient hook 140 depresses an exposed portion of the cable 30 against the top of housing 16. The resilient hook 140 absorbs slight displacements of cable 30 but is easily broken or deformed to release the cable 30 when large displacements of the cable occur such as during removal of the extinguisher.

Having thus described important features of the present invention, the general operation of the alarm device can be easily explained in a brief description. Regardless of whether the housing 16 is secured to the fire extinguisher as shown in FIG. 1 or secured to the stationary storage post as shown in FIG. 2, the storage position of the fire extinguisher 14 with respect to the wall 32 of the stationary support post is fixed. Accordingly, once the fire extinguisher 14 is mounted in its predetermined position, the flexible cable 30 is cut to appropriate length so that it extends from the lowermost end of the tube 114 to the wall 32 in as short a length as possible. Thus, whenever movement of the fire extinguisher 14 occurs, flexible cable 30 is pulled out of the tube 114 and away from the block housing 106. Consequently, decrease in magnetic field strength at the reed switch 100 permits the resiliency of the reed to close the contacts 102 and 104 in a well known manner. When the switch is closed, the circuit is complete between the battery 82 and the alarm 74 so that the alarm begins to emit a continuous audible signal. With respect to FIG. 3, opening of the door 62 causes similar movement of the cable 30 and causes an alarm to sound even before the fire extinguisher has been removed from the cabinet 60.

Since the tube 114 is curved within the housing 116, it will be understood that only a flexible member can be inserted therein to reach the switch 92. Accordingly, it is not possible for a vandal or other prankster to insert a screwdriver or the like within the opening 34 in order to shut off the alarm system. Moreover, once the fire extinguisher has been moved away from the wall 32, the cable is too short to reach the switch 92 and can no longer be reinserted in the housing 16. Since the aperture 34 provides the only access from the exterior of the housing 16, when the cover plate 70 is secured on the housing 16, it will be necessary to remove the cover plate 70 in order to shut off the alarm. Nevertheless, the switch 90 closes contact between the battery 82 and the alarm 74 when the cover plate 70 is removed. Thus, the device provides a signal to warn that the alarm device 10 has been opened.

When the cable 30 is used as a locking pin through the registering apertures in the handle of the fire extinguisher 14, it will be seen that the fire extinguisher becomes inoperable unless the alarm is sounded. Since one end of the cable 30 is fixedly secured to either the neck 22 of the fire extinguisher 14 or the wall 32, that end cannot be slid through the registering apertures and only the other end which is inserted within the housing 16 can be slid through those registering apertures. Accordingly, the cable 30 must be removed from the housing 16 to unlock the handle of the fire extinguisher, whereby an audible signal is produced.

Having thus described my invention, many modifications thereto will become apparent to those skilled in the art to which it pertains without departing from the scope and spirit of the present invention as defined in the appended claims. Although the present invention is particularly useful for detection of the removal of fire extinguishing equipment as used and described in the present application, it is to be understood that the device is not so limited. Rather, it is within the scope of the present invention to apply the device in the manner taught to other portable articles or to articles which are displaceable with respect to one another. Accordingly, for example, movement of building doors or household appliances can be detected by the device of the present invention.

What is claimed is:

1. An alarm for detection of dislocation of a portable fire extinguisher from a relatively stationary storage post comprising:

a substantially enclosed alarm housing having an audible alarm and means for energizing said alarm enclosed therein, and said housing further including a tubular passageway open at one end to the exterior of the housing;

switch means for activating said energizing means comprising an elongated, flexible member, a first free end of said elongated member being slidably receivable in said tubular passageway, and a means fixedly positioned with respect to said tubular passageway responsive to the position of said first end for activating and deactivating said energizing means so that with said flexible member inserted in said tubular passage to a position merely adjacent to, but not in electrical contact with said responsive means, said switch means deactivates said energizing means and so that with said flexible member spaced apart from said responsive means, said switch means activates said energizing means; and said alarm housing being fixed relative to one of said fire extinguisher or said relatively stationary post, and a second end of said elongated member being fixed to a structural element displaceable with respect to said one of said fire extinguisher or said stationary post.

2. The invention as defined in claim 1 wherein said housing includes a cover plate and means for removably securing said cover plate, and including additional switch means for actuating said alarm energizing means when said cover plate is removed.

3. The invention as defined in claim 1 and further comprising a harness means for securing said alarm housing to said fire extinguisher.

4. The invention as defined in claim 1 and further comprising means for securing said alarm housing to the stationary storage post.

5. The invention as defined in claim 1 and further comprising means for resiliently retaining said flexible member within said tubular passageway.

6. The invention as defined in claim 5 wherein said retaining means releasably retains said flexible member within said tubular passageway.

7. An alarm for detection of dislocation of a portable fire extinguisher from a relatively stationary storage post comprising:

a substantially enclosed alarm housing having an audible alarm and means for energizing said alarm enclosed therein, and said housing further including a curved tubular passageway open at one end to the exterior of the housing;

switch means for activating said energizing means comprising an elongated, flexible member, a first end of said elongated member being slidably receivable in said tubular passageway, and a means fixedly positioned with respect to said tubular passageway responsive to the position of said first end for activating and deactivating said energizing means so that with said flexible member inserted in said tubular passage adjacent said responsive means, said switch means deactivates said energizing means and so that with said flexible member spaced apart from said responsive means, said switch means activates said energizing means; and said alarm housing being fixed relative to one of said fire extinguisher or said stationary post, and a second end of said elongated flexible member being fixed to a structural element displaceable with respect to said one of said fire extinguisher or stationary post.

8. An alarm for detection of dislocation of a portable fire extinguisher from a relatively stationary storage post comprising:

a substantially enclosed alarm housing having an audible alarm and means for energizing said alarm enclosed therein, and said housing further including a tubular passageway open at one end to the exterior of the housing;

switch means for activating said energizing means comprising an elongated, flexible member, a first end of said elongated member being slidably receivable in said tubular passageway, and a means fixedly positioned with respect to said tubular passageway responsive to the position of said first end for activating and deactivating said energizing means so that with said flexible member inserted in said tubular passage adjacent said responsive means, said switch means deactivates said energizing means and so that with said flexible member spaced apart from said responsive means, said switch means activates said energizing means;

said alarm housing being fixed relative to one of said fire extinguisher or said stationary post, and a second end of said elongated member being fixed to a structural element displaceable with respect to said one of said fire extinguisher or said stationary post; and wherein said fire extinguisher includes a handle, a spray head housing, means for pivotally securing said handle to said spray head housing and registering apertures in said handle and spray head housing adapted to receive a locking pin therethrough for locking the handle in its inoperative position on the spray head, and wherein said flexible member is slidably insertable within said registering apertures to form said locking pin.

9. An alarm for detection of dislocation of a portable fire extinguisher from a relatively stationary storage post comprising:

a substantially enclosed alarm housing having an audible alarm and means for energizing said alarm enclosed therein, and said housing further including a tubular passageway open at one end to the exterior of the housing;

switch means for activating said energizing means comprising an elongated, flexible member, a first end of said elongated member being slidably receivable in said tubular passageway, and a means fixedly positioned with respect to said tubular passageway responsive to the position of said first end for activating and deactivating said energizing means so that with said flexible member inserted in said tubular passage adjacent said responsive means, said switch means deactivates said energizing means and so that with said flexible member spaced apart from said responsive means, said switch means activates said energizing means; and said alarm housing being fixed relative to one of said fire extinguisher or said stationary post, and a second end of said elongated member being fixed to a structural element displaceable with respect to said one of said fire extinguisher or said stationary post; and wherein said responsive means further comprises a reed switch disposed on one side of said tubular passageway and a permanent magnet disposed on the opposite side of said tubular passageway adjacent said reed switch, and wherein said flexible member is made of a material having a magnetic permeability greater than air.

10. The invention as defined in claim 9 wherein said switch means further comprises a switch housing made of nonmagnetic material having a central bore dimensioned to receive said tubular passageway, a second bore on one side of said central bore dimensioned to receive said reed switch, and a third bore on the opposing side of said central bore dimensioned to receive said permanent magnet.

* * * * *

UNITED STATES PATENT AND TRADEMARK OFFICE

CERTIFICATE OF CORRECTION

PATENT NO. : 4,418,336

DATED : November 29, 1983

INVENTOR(S) : John D. Taylor

It is certified that error appears in the above—identified patent and that said Letters Patent is hereby corrected as shown below:

Column 3, line 35 after "free" insert --end--.

Signed and Sealed this

*Eighth* Day of *May 1984*

[SEAL]

*Attest:*

GERALD J. MOSSINGHOFF

*Attesting Officer*

*Commissioner of Patents and Trademarks*